US008425200B2

(12) United States Patent
Tran et al.

(10) Patent No.: US 8,425,200 B2
(45) Date of Patent: Apr. 23, 2013

(54) PUMP CONTROLLER

(75) Inventors: Derrick Thanh Tran, Yorba Linda, CA (US); Thang Quoc Dang, Huntington Beach, CA (US); Rufino Naval, Jr., San Juan Capistrano, CA (US); David L. Phillips, Santa Ana, CA (US); Jignesh N. Pandya, Vadodara (IN); Ujjaval D. Joshi, Gujarat (IN)

(73) Assignee: Xylem IP Holdings LLC., White Plains, NY (US)

( * ) Notice: Subject to any disclaimer, the term of this patent is extended or adjusted under 35 U.S.C. 154(b) by 43 days.

(21) Appl. No.: 12/799,294

(22) Filed: Apr. 20, 2010

(65) Prior Publication Data

US 2011/0255992 A1 Oct. 20, 2011
US 2012/0321484 A9 Dec. 20, 2012

Related U.S. Application Data

(60) Provisional application No. 61/171,254, filed on Apr. 21, 2009.

(51) Int. Cl.

| | |
|---|---|
| ***F04B 49/00*** | (2006.01) |
| ***G05D 7/00*** | (2006.01) |
| ***G05D 11/00*** | (2006.01) |
| ***F02B 53/10*** | (2006.01) |

(52) U.S. Cl.
USPC ..... 417/31; 700/282; 123/206

(58) Field of Classification Search ..... 700/275, 700/282; 417/9, 15, 18, 19, 25, 31, 53; 123/205, 123/206, 495, 497
See application file for complete search history.

(56) References Cited

U.S. PATENT DOCUMENTS

| | | | |
|---|---|---|---|
| 4,112,538 | A | 9/1978 | Bates |
| 5,207,148 | A | 5/1993 | Anderson et al. |
| 5,509,349 | A | 4/1996 | Anderson et al. |

(Continued)

FOREIGN PATENT DOCUMENTS

| | | |
|---|---|---|
| EP | 0226858 | 7/1987 |
| EP | 0472272 | 2/1992 |

(Continued)

OTHER PUBLICATIONS

Zhou Guanxu et al., "Adaptive PID Control for Hydraulic Pump System based on Fuzzy Logic", IEEE 6th International Power Electronics and Motion Control Conference, 2009, pp. 2068-2071.*

(Continued)

*Primary Examiner* — Crystal J Barnes-Bullock

(57) ABSTRACT

The present invention provides a technique using current sensing to control the pressure at constant level without the direct sensing of the pressure. This technique will help to reduce dependency solely on switch or sensor and their non linearity and other associated problems such as the non-repetitive behavior, being affected by EMI etc. The technique includes using a pump controller featuring one or more modules configured to respond to one or more input signals containing information about current provided from a pump; and configured to provide one or more output signals containing information to control the pump to operate at a substantially constant pressure without the direct sensing of pump pressure. The one or more modules control the operation of the pump based at least partly on a table of characteristics related to voltage and current that is calibrated for each pump.

22 Claims, 13 Drawing Sheets

Control Block Diagram

U.S. PATENT DOCUMENTS

| | | | | |
|---|---|---|---|---|
| 5,591,249 | A | 1/1997 | Hankins | |
| 5,597,403 | A | 1/1997 | Hankins | |
| 5,678,521 | A | 10/1997 | Thompson et al. | |
| 5,725,357 | A | 3/1998 | Nakazeki et al. | |
| 6,091,887 | A | 7/2000 | Dieterle et al. | |
| 6,347,645 | B2 | 2/2002 | Gurubatham et al. | |
| 6,453,878 | B1 * | 9/2002 | Mazet | 123/497 |
| 6,576,118 | B2 * | 6/2003 | Ohkuma | 205/784.5 |
| 6,942,469 | B2 | 9/2005 | Seale et al. | |
| 7,023,166 | B1 | 4/2006 | Kohen et al. | |
| 7,078,825 | B2 | 7/2006 | Ebrahim et al. | |
| 7,117,120 | B2 | 10/2006 | Beck et al. | |
| 7,309,025 | B2 * | 12/2007 | Yamazaki et al. | 239/5 |
| 2002/0136642 | A1 | 9/2002 | Moller | |
| 2004/0062658 | A1 | 4/2004 | Beck et al. | |
| 2004/0104695 | A1 | 6/2004 | Hahn et al. | |
| 2004/0186648 | A1 * | 9/2004 | Zheng et al. | 701/70 |
| 2007/0007929 | A1 | 1/2007 | Lee et al. | |
| 2007/0040454 | A1 | 2/2007 | Freudenberger et al. | |
| 2007/0041845 | A1 | 2/2007 | Freudenberger | |
| 2007/0196214 | A1 | 8/2007 | Bocchiola | |
| 2007/0290645 | A1 | 12/2007 | Boyadjieff et al. | |
| 2008/0067116 | A1 | 3/2008 | Anderson et al. | |
| 2010/0274467 | A1 * | 10/2010 | Hayami | 701/103 |
| 2011/0251500 | A1 * | 10/2011 | Sawanoi | 600/494 |
| 2011/0276212 | A1 * | 11/2011 | Wu | 701/22 |

FOREIGN PATENT DOCUMENTS

| | | |
|---|---|---|
| EP | 0584713 | 3/1994 |
| EP | 0978657 | 2/2000 |
| EP | 2246569 A2 * | 11/2010 |
| JP | 57084712 | 5/1982 |
| JP | 63208642 | 8/1988 |
| WO | 0025416 | 5/2000 |

OTHER PUBLICATIONS

English language translation of EP0226858 abstract.
4 pages European Search Report dated May 19, 2011.
4 pages Supplemental European Search Report dated Aug. 26, 2011.
JP63208642 English Language Translation of Abstract.
JP57084712 English Language Translation of Abstract.

* cited by examiner

Block Diagram of Pump Controller

Block Diagram Of Pump Controller

Graph Of Head–Flow Curve

V−1 characteristic at a constant pressure for a diaphragm pump

Control Block Diagram

Graph Of Current vs. Voltage At Constant Pressure

Functional Flow Chart

Functional Flow Chart

Functional Flow Chart

Functional Flow Chart

Functional Flow Chart

Functional Flow Chart

Functional Flow Chart

Flow Curve/Operating Envelope

LED Indicator Code

PUMP CONTROLLER

CROSS REFERENCE TO RELATED APPLICATIONS

This application claims benefit to provisional patent application Ser. No. 61/171,254, filed 21 Apr. 2009.

BACKGROUND OF THE INVENTION

1. Field of the Invention

The present invention relates to a technique for controlling the operation of a pump, including providing a method of controlling the operation of a pump at a constant pressure using motor current as a sensing parameter and motor voltage as a controlling parameter.

More particularly, the present invention relates to a method and apparatus using a pump control to keep an outlet pressure constant based at least partly on sensing motor current and a unique algorithm of tracking the V-I characteristics of a pump.

2. Brief Description of Related Art

Many pumps known in the art include a mechanical pressure switch, or semiconductor hall sensors, or load cells, or any other type of electronic pressure sensing device, that shuts off the pump when certain pressure (i.e., the shut-off pressure) is exceeded. The pressure switch, hall sensor or load cell is typically positioned in physical communication with the fluid in the pump. When the pressure of the fluid exceeds the shut-off pressure, the force of the fluid moves the mechanical switch to open the pump's power circuit or generates corresponding electrical signal to trace the set pressure. Mechanical switches have several limitations. For example, during the repeated opening and closing of the pump's power circuit, arcing and scorching often occurs between the contacts of the switch. The pressure cannot remain constant because of the non-repetitive and/or non-linear behavior. So relying totally on the pressure switch or sensor will always give an inconsistence control loop.

In view of this, there is a need in the art for an improved pump controller that solves the problems related to the mechanical pressure switches or sensors in the known pump designs.

SUMMARY OF THE INVENTION

To overcome the aforementioned problems with the mechanical pressure switch and pressure sensor, a new technique is provided using current sensing to control the pressure at a constant level without the direct sensing of the pressure. This new technique will help to reduce the dependency solely on the pressure switch or sensor and their non linearity and other associated problems such as the non-repetitive behavior, as well as other known problems associated with being affected by electromagnetic interference (EMI), etc.

According to some embodiments, the present invention may take the form of apparatus, such as a pump controller, featuring one or more modules configured to respond to one or more input signals containing information about current provided from a pump; and also configured to provide one or more output signals containing information to control the pump to operate at a substantially constant pressure without the direct sensing of pump pressure.

Embodiments of the present invention may also include one or more of the following features:

For example, the one or more modules may be configured to control the operation of the pump based at least partly on a table of characteristics related to voltage and current that is calibrated for each pump, where the characteristics may be determined with the following equation:

$$I=Vm+C,$$

where m=(I1−I2)/(V1−V2),

C=(V1*I2−V2*I1)/(V1−V2), (V1, I1): Low point of curve, and (V2, I2): High point of curve.

The one or more input signals may contain information about a sensed actual motor current to operate the pump, and the one or more output signals may contain information about a voltage read from the table that corresponds to the sensed actual motor current. The one or more input signals may also contain information about a comparison of the sensed actual motor current with a set current. The one or more modules may also be configured to provide a correction term to control the pump to operate at the substantially constant pressure.

Either the one or more modules or the apparatus as a whole may be configured as a PID controller for controlling the operation of the pump.

The apparatus may also take the form of a controller featuring one or more signal processing modules configured to respond to one or more input signals containing information about current provided from a pump; and configured to provide one or more output signals containing information to control the pump to operate at a substantially constant pressure without the direct sensing of pump pressure. Embodiments of the controller may include one or more of the features described herein. The controller may also form part of a pumping system or arrangement that includes the pump.

The present invention may also take the form of a method featuring steps for controlling the pump, including responding to one or more input signals containing information about current provided from a pump; and providing one or more output signals containing information to control the pump to operate at a substantially constant pressure without the direct sensing of pump pressure. Embodiments of the method may include steps for implementing one or more of the features described herein.

The present invention may also take the form of a computer program product having a computer readable medium with a computer executable code embedded therein for implementing the steps of the method when run on a signaling processing device that forms part of such a pump controller like element 10. By way of example, the computer program product may take the form of a CD, a floppy disk, a memory stick, a memory card, as well as other types or kind of memory devices that may store such a computer executable code on such a computer readable medium either now known or later developed in the future.

BRIEF DESCRIPTION OF THE DRAWING

The drawing includes the following Figures, not drawn to scale:

FIG. 1 includes FIGS. 1*a* and 1*b*, where

FIG. 6, which includes

DETAILED DESCRIPTION OF THE INVENTION

Figure 1A:
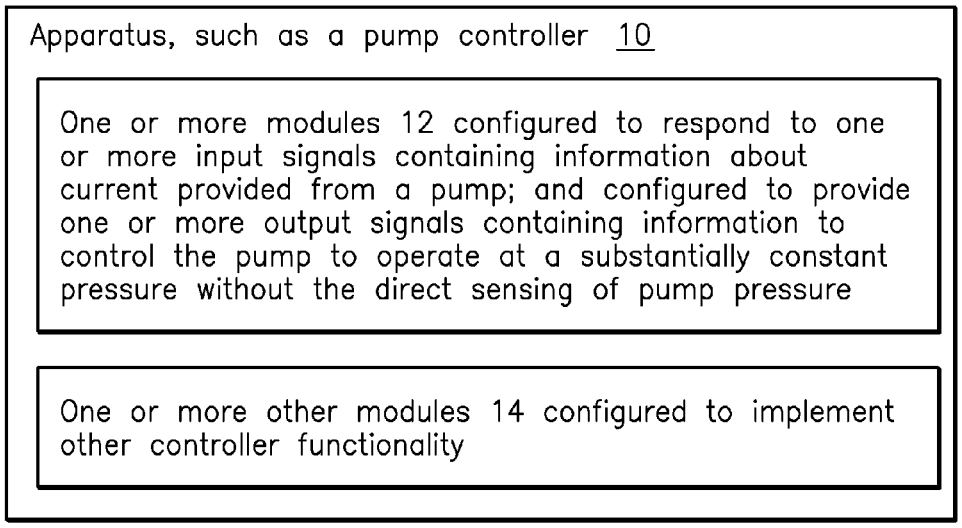
FIG. 1*a* is a block diagram of apparatus, including a pump controller, according to some embodiments of the present invention; and where

FIG. 1*a* shows apparatus in the form of a pump controller generally indicated as 10 featuring one or more modules 12 and 14. The one or more modules 12 is configured to respond to one or more input signals containing information about current provided from a pump (see element 30 (FIG. 4); and also configured to provide one or more output signals containing information to control the pump 30 (FIG. 4) to operate at a substantially constant pressure without the direct sensing of pump pressure.

According to some embodiments of the present invention, the one or more modules 12 may be configured to control the operation of the pump 30 (FIG. 4) based at least partly on a table of characteristics related to voltage and current that is calibrated for each pump, where the characteristics may be determined with the following equation:

$$I=Vm+C,$$

where m=(I1−I2)/(V1−V2),

C=(V1*I2−V2*I1)/(V1−V2), (V1, I1): Low point of curve, and (V2, I2): High point of curve.

The one or more input signals may contain information about a sensed actual motor current to operate the pump, and the one or more output signals may contain information about a voltage read from a calibration table that corresponds to the sensed actual motor current. The one or more input signals may also contain information about a comparison of the sensed actual motor current with a set current. The one or more modules 12 may also be configured to provide a correction term to control the pump to operate at the substantially constant pressure.

Either the one or more modules 12 or the apparatus 10 as a whole may be configured as, or form part of, a module (see element 40 (FIG. 4)) having a PID controller 41 along with other components or modules 42, 44, 46, 48 described below for controlling the operation of the pump 30. As shown, the module 40 includes, e.g., one or more signal processing modules configured to perform the signal processing for implementing the functionality of the present invention. The PID controller 40 may also form part of a pumping system or arrangement generally indicated as 50 in FIG. 4 for controlling the operation of the pump 30.

The one or more modules 14 may include other modules that may form part of the pump controller to implement other controller functionality that does not form part of the underlying invention, e.g., including input/output functionality for processing signaling to and from a pump/motor, a sensing device, etc., as well as functionality associated with other devices or components, e.g., including a random access memory (RAM) type device, a read only memory (ROM) type device, control and data bus type devices, etc.

The calibration table may form part of, e.g., a memory storage device. The memory storage device itself may form part of the one or more modules 12, the one or more other modules 14, or some combination thereof. Memory storage devices are known in the art, and the scope of the invention is not intended to be limitation to any particular type or kind thereof either now known or later developed in the future.

Figure 1B:
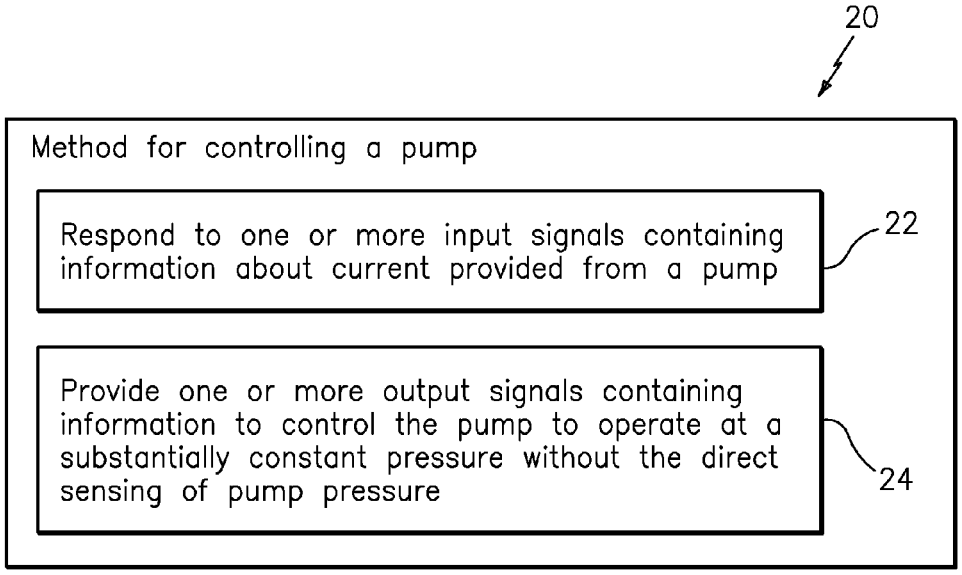
FIG. 1*b* is a block diagram of flowchart of a method for implementing the apparatus of FIG. 1*a* according to some embodiments of the present invention.

The present invention may also take the form of a method shown in FIG. 1*b* having steps 22, 24 that form part of a flowchart generally indicated as 20 for controlling the pump 30 (FIG. 4), including responding to one or more input signals containing information about current provided from the pump 30, e.g. along signal path 42*a* (FIG. 4); and providing one or more output signals, e.g. along signal path 41*a* (FIG. 4), containing information to control the pump 30 to operate at a substantially constant pressure without the direct sensing of pump pressure.

Basic Pump Principle and the Building of the Table

The above indirect relationship between current and pressure according to the present invention is based at least partly on the built-up and working principle of general diaphragm pumps consistent with the following:

As a person skilled in the art would appreciate, in a typical diaphragm pump voltage is applied to a motor which in turn will rotate a rotor. The rotational motion will be transferred to a piston by a cam. The piston will in turn convert the rotational motion into linear motion. The linear motion of the piston to a diaphragm will force fluid from the pump's inlet to its outlet. This force in the outlet area will generate the pressure in fluid flowing out of the outlet.

In operation, if the demand at the pump's outlet is decreased, then the pressure at the outlet will increase. However, the pump is still rotating at the same speed as before. Because of this, the current will start increasing at the motor in response to the increased pressure. In the same way, if the pressure at the pump's outlet is decreased for the desired pressure, then the current flowing from the motor will decrease as the demand of torque to generate more pressure decreases.

Figure 2:
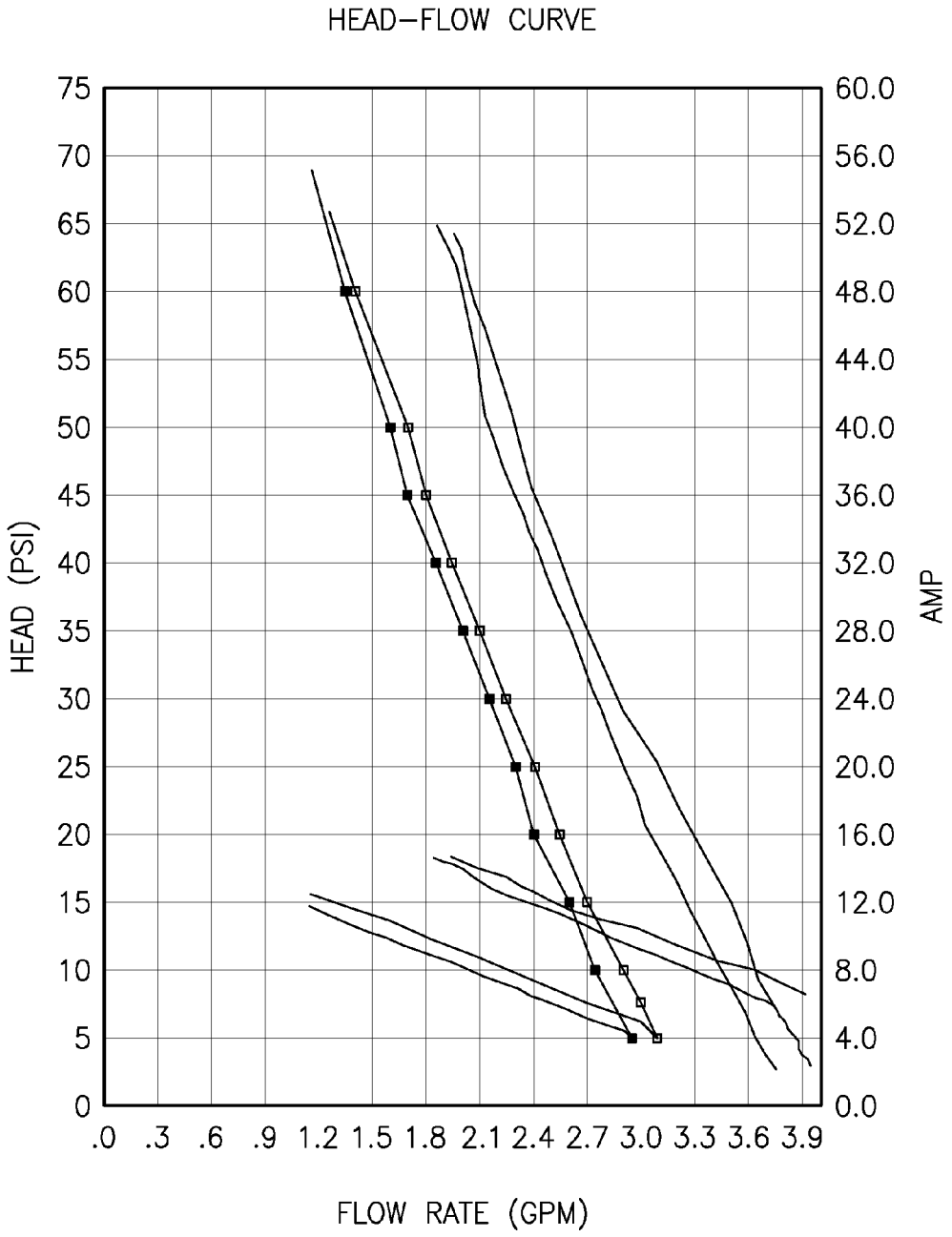
FIG. 2 is a graph of head-flow characteristics for a diaphragm pump.

By way of example, FIG. 2 is provided to show the general head-flow characteristics for a typical diaphragm pump. From the characteristics, the current and voltage are understood to be substantially unique for the head-flow desired. Another important outcome is that the pressure at the two different flow rates is understood not to substantially have the same voltage and current at any given time.

Figure 3:
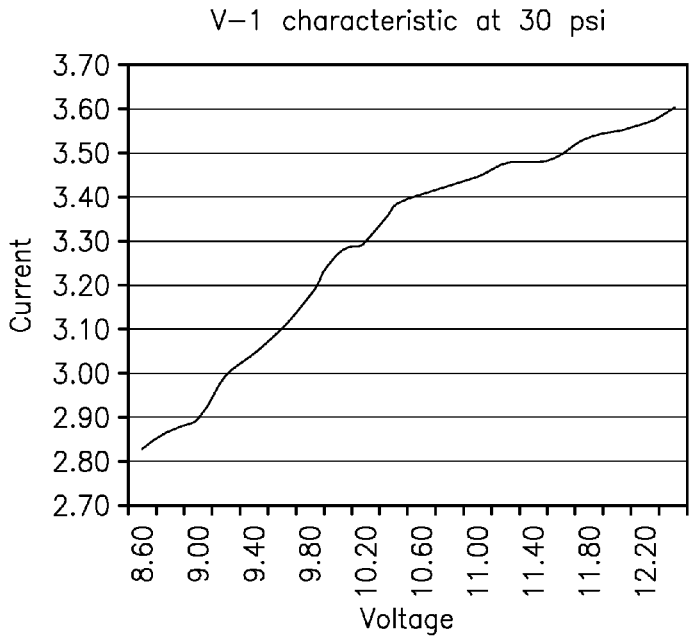
FIG. 3 is a graph of current in relation to voltage showing V-I characteristics at a constant pressure of, e.g., 30 pounds per square inch (PSI) for a diaphragm pump.

To support the understanding of the aforementioned principle, FIG. 3 is provided to show a V-I characteristic at a constant pressure for a typical diaphragm pump, which forms the basis for the table or table look-up technique according to the present invention.

The V-I characteristics can be determined by varying the voltages applied to the pump for its entire operating range (e.g. from 8.5 V to 14.8V for +12V motor and without any control electronics, i.e. a variable speed drive (VSD)) and plotting the current by keeping the pressure constant which is the desired constant pressure at which the pump needs to be maintained when it is in its intended normal operation (e.g., 30 PSI).

It is understood that the respective V-I characteristics in FIG. 3 that determine the table for a given pump are unique for that given pump since V-I characteristics substantially depend on the motor characteristics of that given pump, which typically vary from one motor when compared to another motor. In other words, according to the present invention respective V-I characteristics will be sensed and determined for each pump and a respective table will be formulated for each pump that are unique for each pump, and used to control each pump.

Once the V-I characteristics for the given pump are determined, any controller or control system may be implemented to control the pump at the constant pressure by looking up and following the above obtained trend line (V-I characteristics) using the table loop-up technique according to the present invention.

Figure 4:
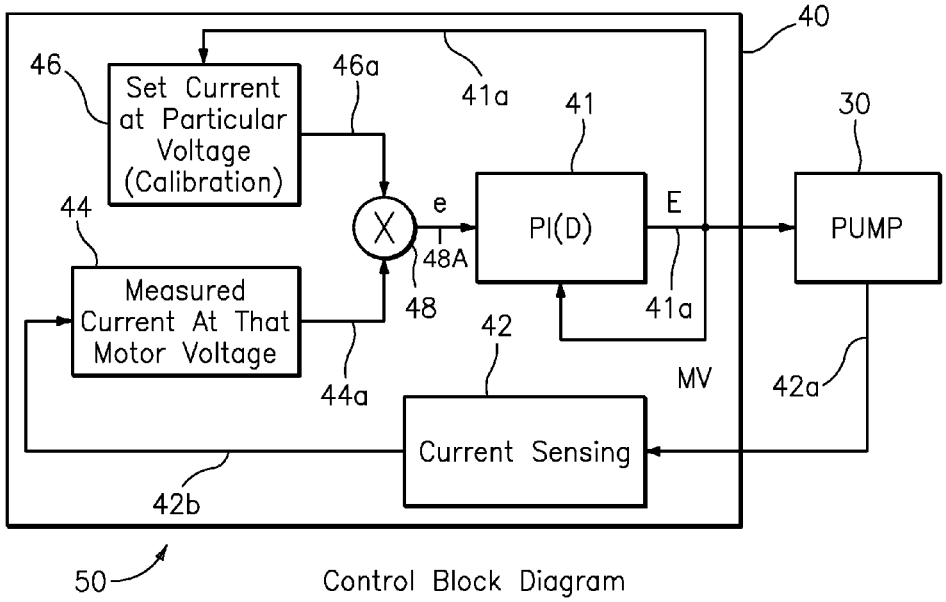
FIG. 4 is a block diagram of apparatus, including a pump system having a controller, according to some embodiments of the present invention.

By way of example, FIG. 4 shows a diagram of a control block for a pump system 50 having a simple yet effective approaches according to some embodiments of the present invention. As shown, the control block or module 40 includes devices, components or modules such as the PI(D) controller module 41, along with other components or modules 42, 44, 46, 48 for controlling the operation of the pump 30. The module 42 senses current from the motor along signal path 42*a*, and provides a current sensing signal along signal path 42*b* containing information about the sensed motor current. The module 44 is configured to respond to the current sensing signal along signal path 42*b*, to measure current at a motor voltage, and provide a measured current signal along signal path 44*a* containing information about the measured current at that motor voltage. The one or more input signals containing information about current provided from the pump 30 (FIG. 4) includes the current sensing signal along signal path 42*b*. The module 46 is configured to respond to a voltage output signal E along signal path 41*a* provided from the PI(D) controller module 41 to the pump 30 along signal path 41*a* for controlling the operation of the pump 30, to set current at a particular voltage (calibration), and provide a signal along signal path 46*a* containing information about the set current at the particular voltage (calibration). The node module 48 is configured to response to the signal along signal path 44*a* containing information about the measured current at the motor voltage and the signal along signal path 46*a* containing information about the set current at the particular voltage (calibration), and provide a signal e along signal path 48*a* to the PI(D) module 41 containing information about the two signals. Consistent with that described in further detail below, the signal e provided from the node module 48 to the PI(D) module 41 along signal path 48*a* contains information about an error between the set current and sensed actual motor current that will be used as input parameter for the PID controller 41. The PI(D) module 41 is configured to respond to one or more input signals, including the signal e along signal path 48*a* that contains information about current provided from the pump 30, as well as voltage output signal E along signal path 41*a* provided from the PI(D) controller module 41 to the pump 30 along signal path 41*a* for controlling the operation of the pump 30. Consistent with that described in further detail below, the voltage signal E from the PI(D) module 41 to the pump 30 along signal path 41*a* will contain the correction term to the motor voltage to get the desire pressure. The one or more output signals containing information to control the pump 30 (FIG. 4) to operate at the substantially constant pressure without the direct sensing of pump pressure includes the voltage output signal E along signal path 41*a*. In operation, the voltage output signal E along signal path 41*a* for controlling the operation of the pump 30 is effectively corrected or modified based at least partly on the control feedback system shown in FIG. 4 that depends on a relationship between the sensed motor current and the information contained in the table calibrated for the respective pump 30 so as to operate the respective pump 30 at the substantially constant pressure without the direct sensing of pump pressure.

The scope of the invention is not intended to be limited to the type or kind of signal path being used to exchange signal between the components or modules shown and described herein. Embodiments are envisioned using signal paths that are hard wired between the components or modules shown and described herein, or wireless communication couplings between the components or modules shown and described herein, or some combination thereof, as well as other types or kinds of signal paths either now known or later developed in the future.

Figure 5:
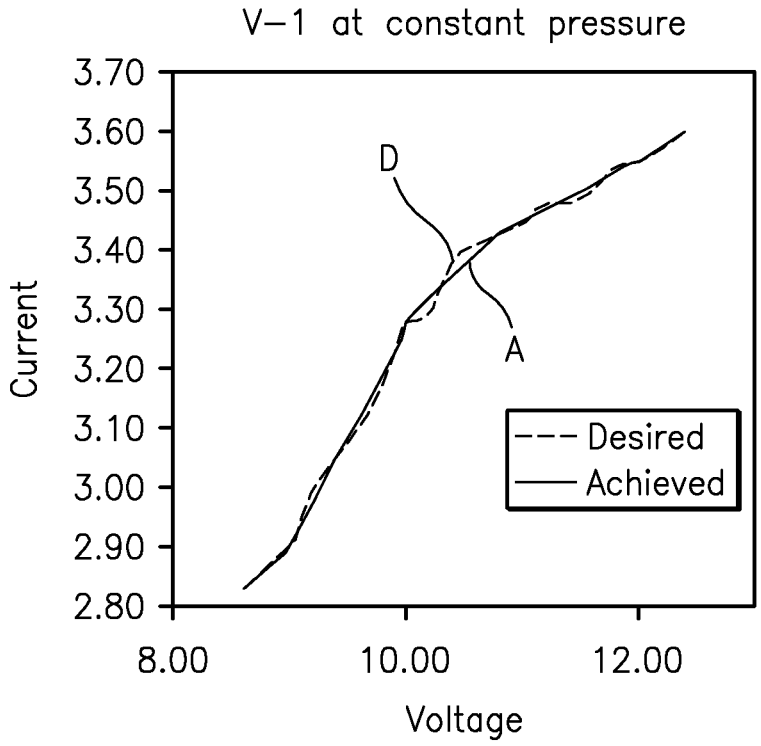
FIG. 5 shows a graph of current in relation to voltage having V-I characteristics for desired current and achieved current at a constant pressure for a diaphragm pump according to some embodiments of the present invention.
Figure 6A:
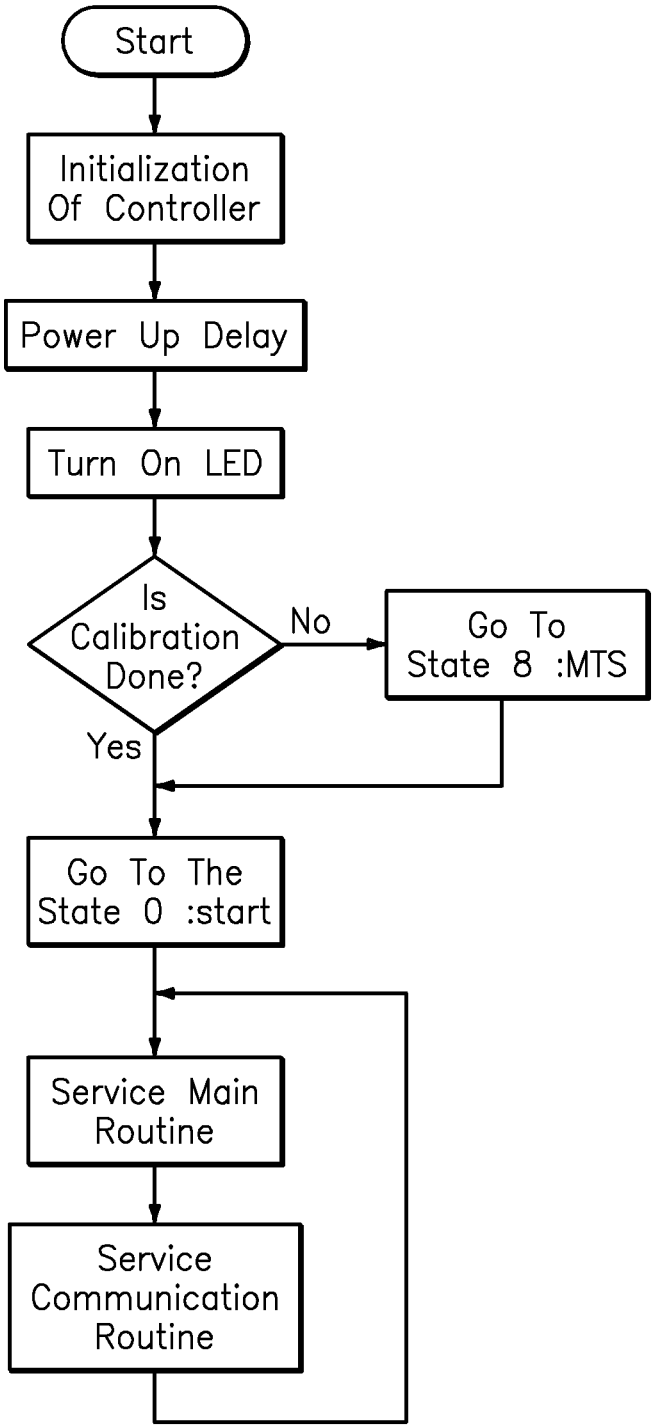
FIGS. 6*a* through 6*h*, shows a functional flow chart showing steps for implementing the apparatus according to some embodiments of the present invention.
Figure 6B:
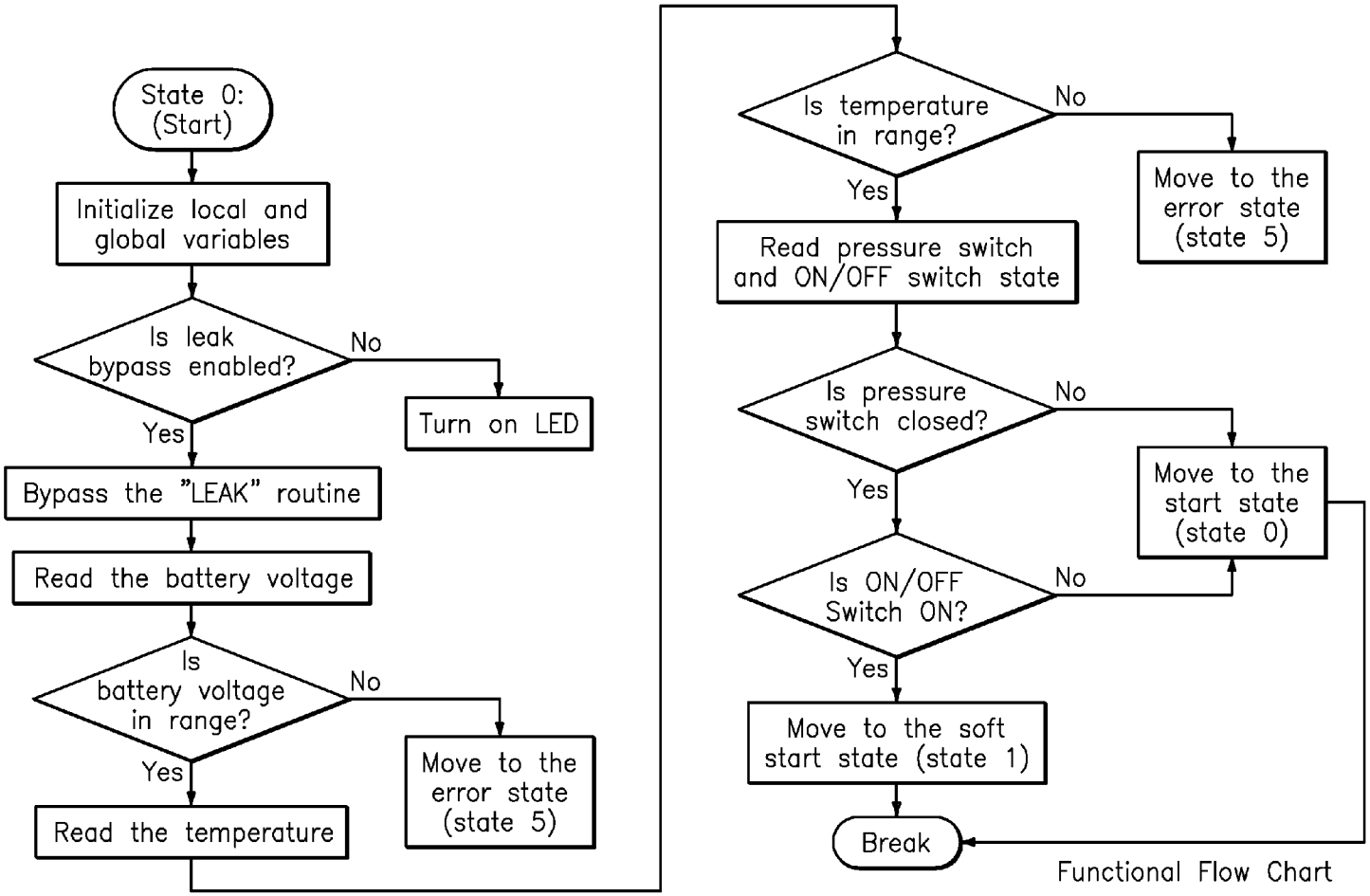
Figure 6C:
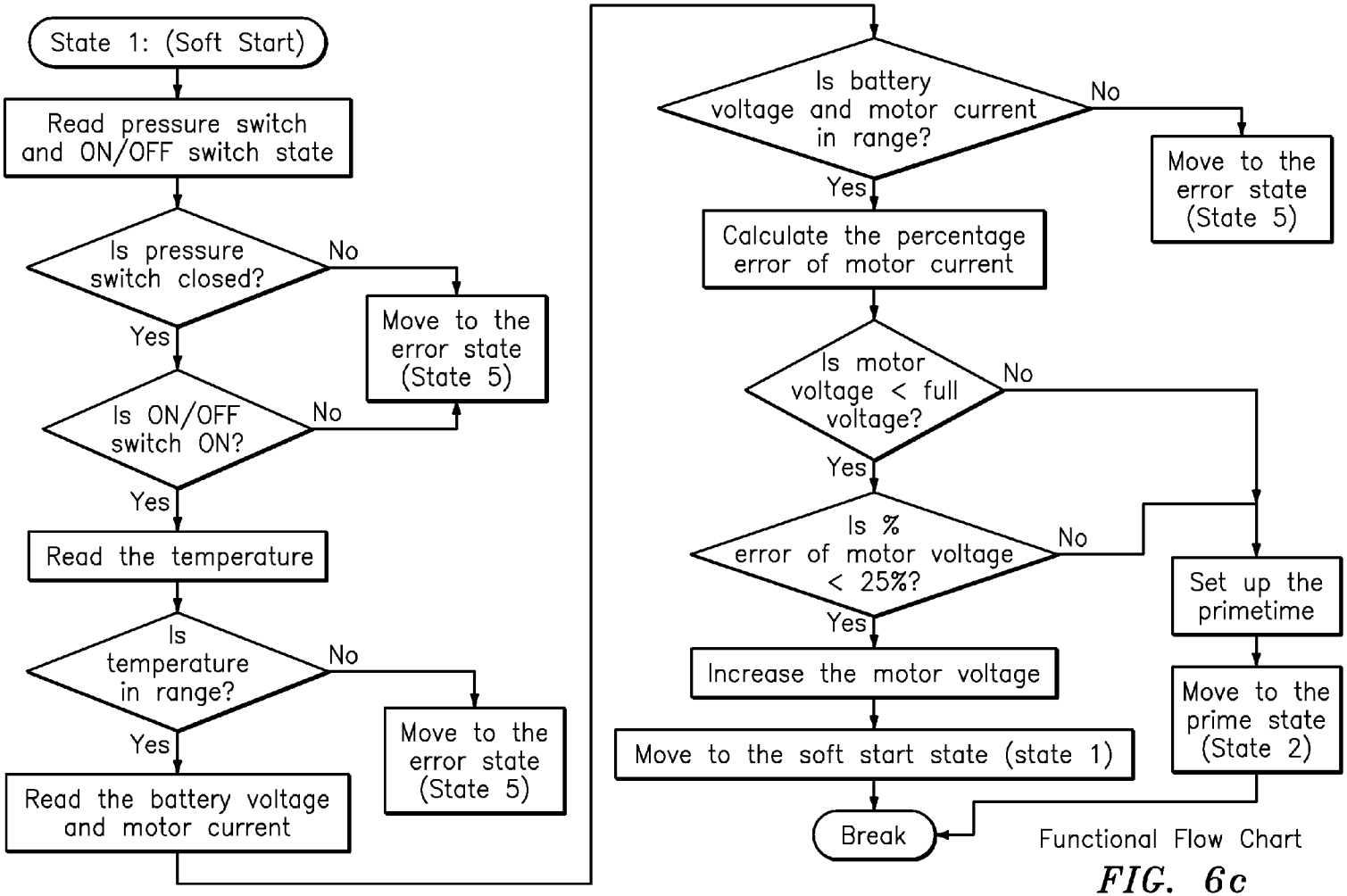
Figure 6D:
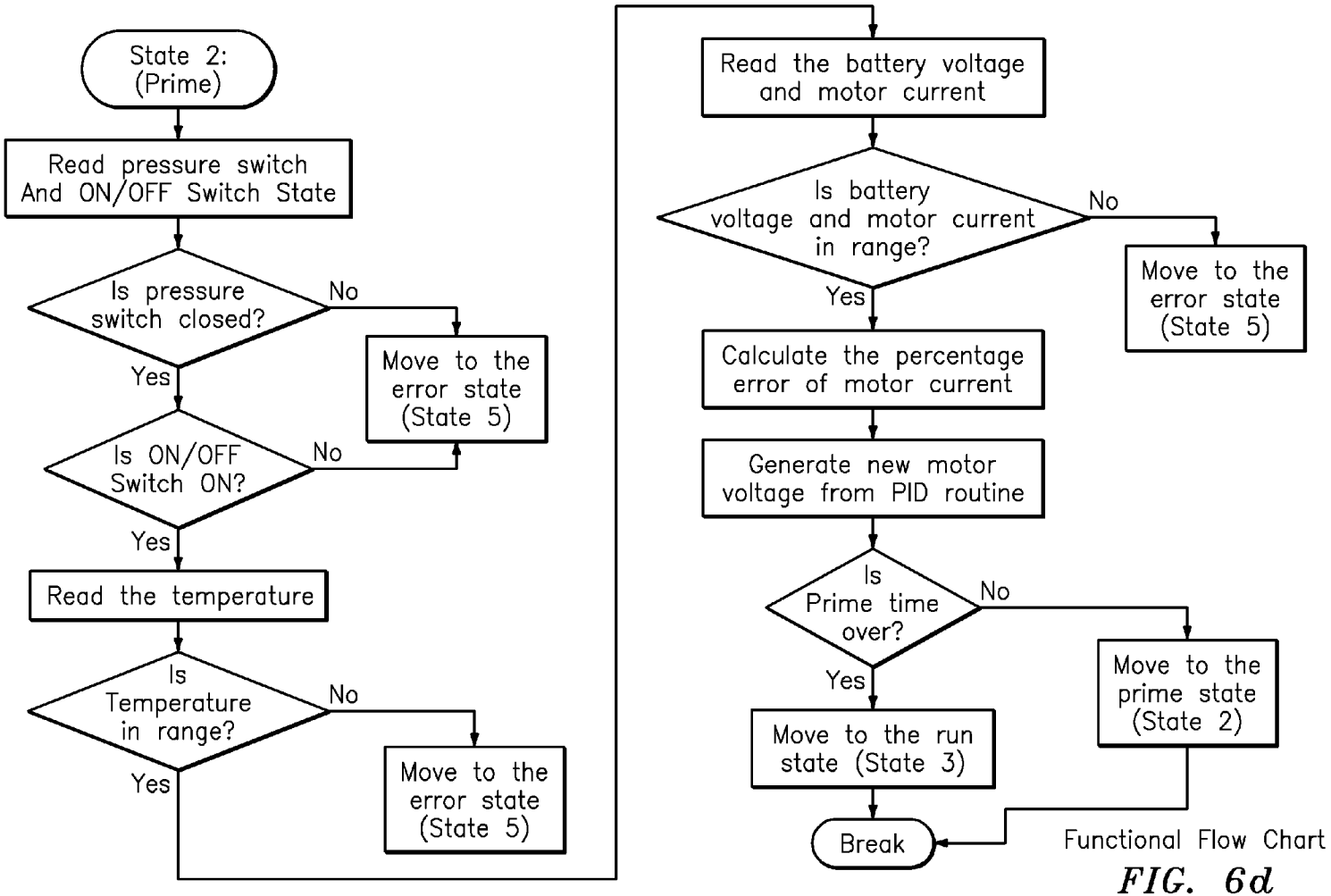
Figure 6E:
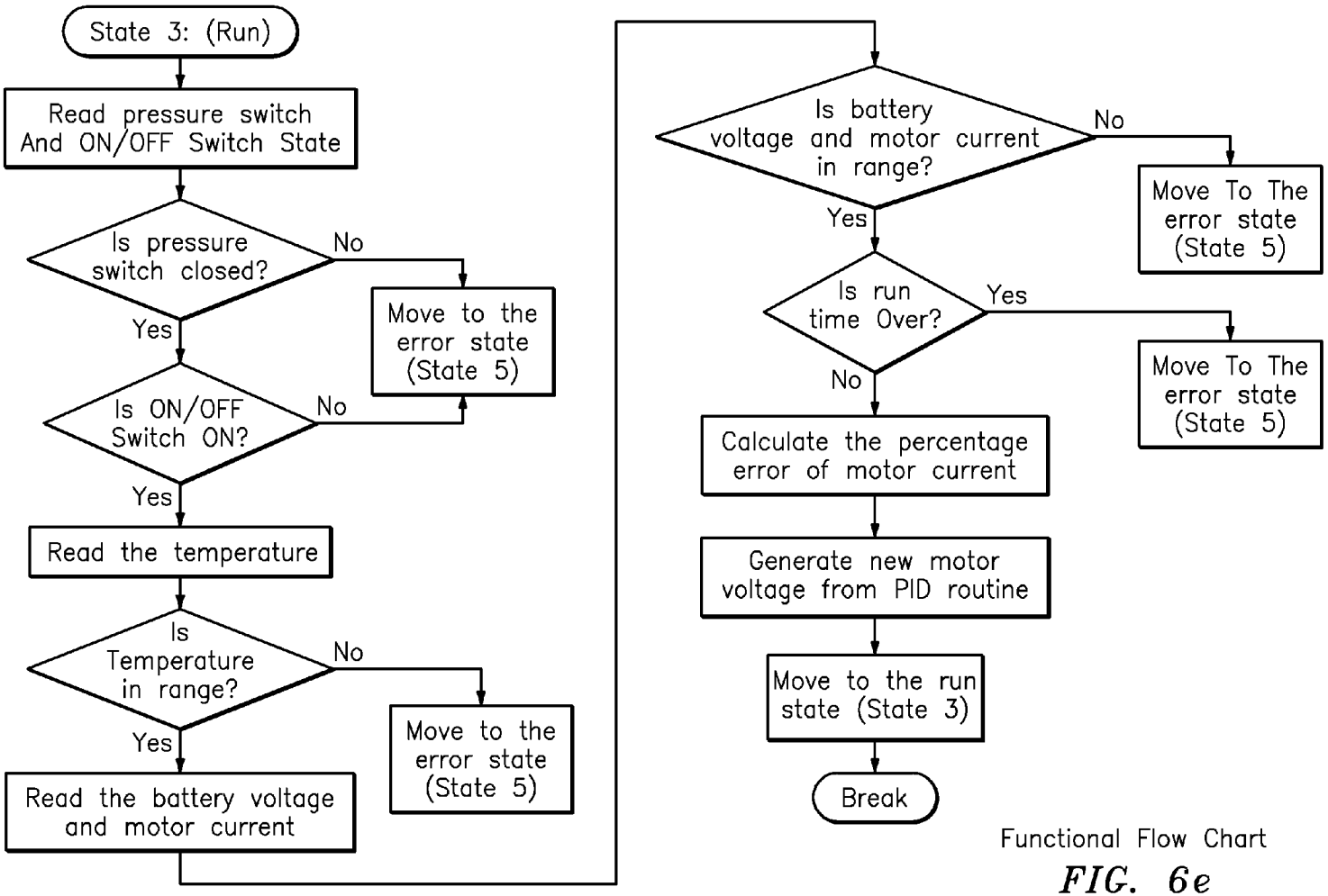
Figure 6H:
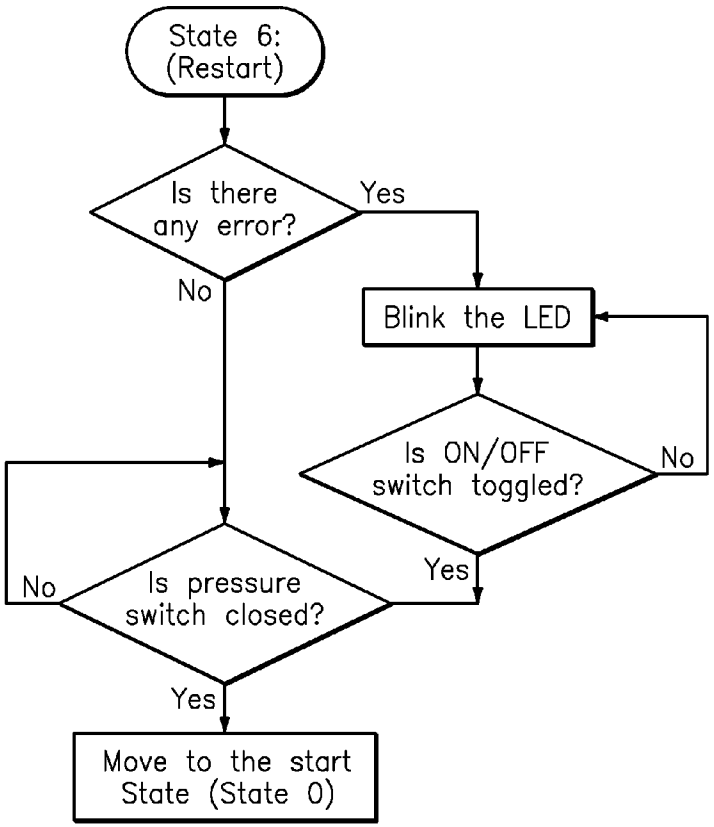
Figure 6F:
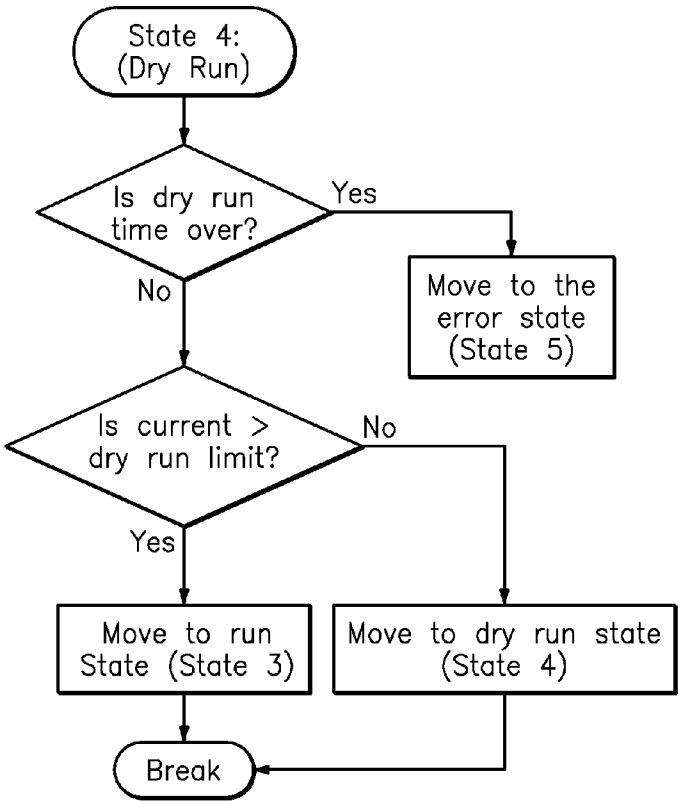
Figure 6G:
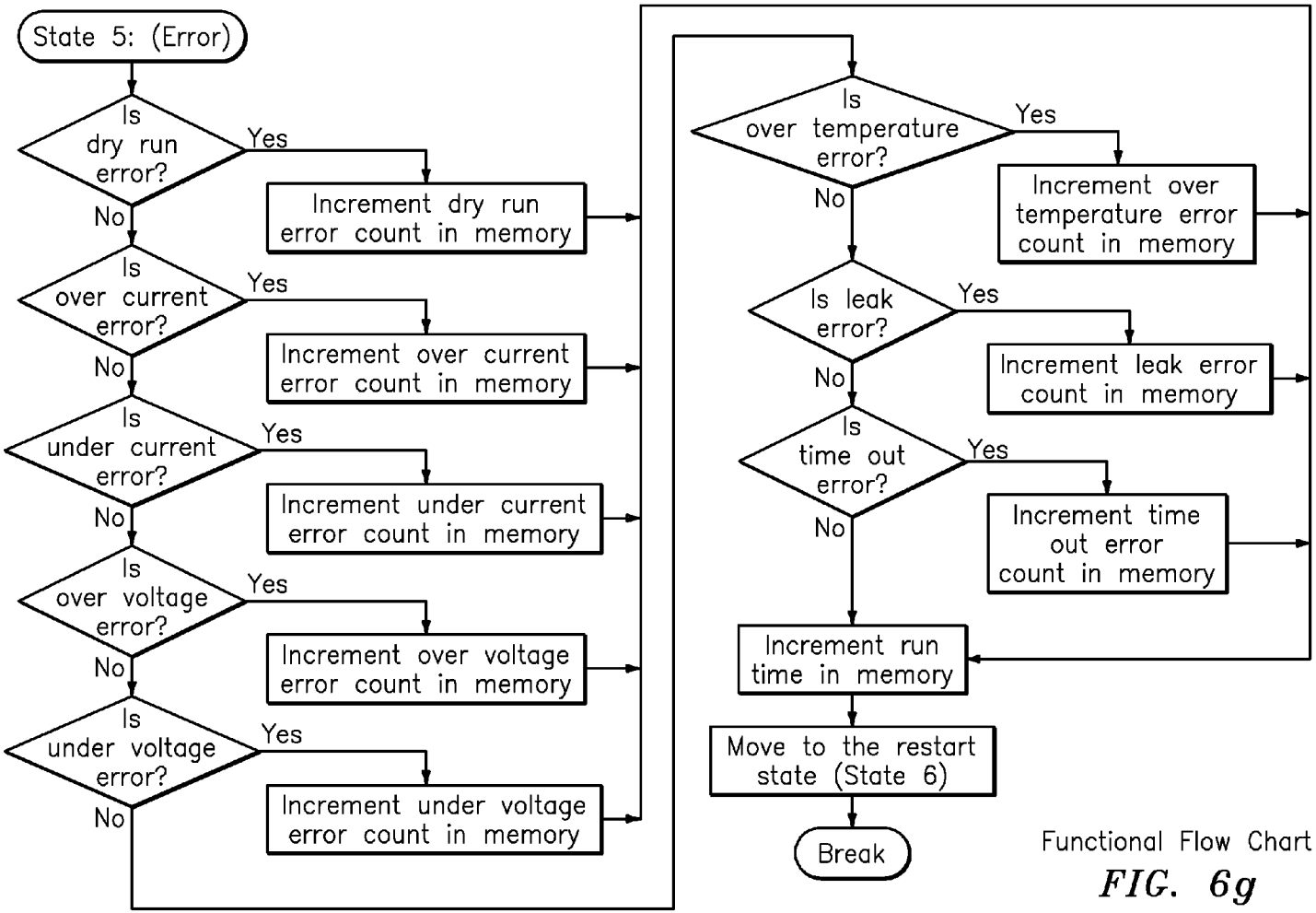

FIG. 5 shows a graph of current in relation to voltage having V-I characteristics for desired current indicated as D (shown as having a lighter colored function) and achieved current indicated as A (shown as having a darker colored function) at a constant pressure without the direct sensing of pump pressure for controlling the operation of a diaphragm pump according to some embodiments of the present invention. In operation, the one or more modules 12 (FIG. 1) or 41 (FIG. 4) is configured to provide a correction term, e.g., in the form a modified voltage signal along signal path 41*a*, to control the pump so as to operate at the substantially constant pressure, such that the desired current D and achieved current A have similar values at a similar motor voltage as shown in the graph FIG. 5 for controlling the operation of a diaphragm pump without the direct sensing of pump pressure, according to some embodiments of the present invention.

This control implementation according to the present invention as described herein provides a highly accurate, seamless yet easy to implement control algorithm, which provides a piece-wise linear approach that is easy to calibrate (obtain the V-I characteristics) and has less computational burden on the controller.

The reproduction of the V-I curve is done using the piece-wise linear method. According to the piece-wise linear method, the curve is divided in number (ideally infinite) small linear lines. Here one take two points (calibration point) and the relation between those two consecutive points will have the linear relation. This relation may be defined with following equation.

$$I=Vm+C$$

$$m=(I1-I2)/(V1-V2)$$

$$C=(V1*I2-V2*I1)/(V1-V2)$$

(V1, I1): Low point of curve;

(V2, I2): High point of curve;

In normal condition, the pump will sense the actual motor current and apply the voltage to the motor. The same voltage will be sent to the set current prediction logic to get the set current for the desired pressure at the present motor voltage. The sensed actual motor current will be compared with the set current (desired current at that voltage for desired pressure—from the calibration table). The error between the set current and sensed actual motor current will be used as input parameter for the PID controller. The PID controller will generate the correction term to the motor voltage (controller by duty cycle) to get the desire pressure. Next time the above steps are repeated at a constant and very fast rate.

Once the algorithm is implemented consistent with that set forth herein, through electronics and signaling processing, the one or more output signals along signal path 41*a* may be provided to get the output that gives the constant desired pressure at the pump's output through the predictive algorithm approach according to the present invention.

V-I Curve Equation

The following is a description regarding the V-I curve equation:

From a general linear equation:

$$I=mV+C,$$

where: $(V_1, I_1)$: Low point of curve, and $(V_2, I_2)$: High point of curve, one has:

$$\frac{I-I_2}{I_1-I_2}=\frac{V-V_2}{V_1-V_2}$$

$$I-I_2=(V-V_2)\frac{(I_1-I_2)}{(V_1-V_2)}$$

$$I=\frac{(I_1-I_2)V}{V_1-V_2}-\frac{V_2(I_1-I_2)}{V_1-V_2}+I_2$$

Thus:

$$m=\frac{(I_1-I_2)}{V_1-V_2}$$

$$C=\frac{V_2(I_2-I_1)}{V_1-V_2}+I_2$$

$$C=\frac{V_2(I_2-I_1)+I_2(V_1-V_2)}{V_1-V_2}$$

Or $$C=\frac{V_1I_2-V_2I_1}{V_1-V_2}$$

Based at least partly on this, the V-I Curve is:

$$I=\frac{(I_1-I_2)}{V_1-V_2}V+\frac{V_1I_2-V_2I_1}{V_1-V_2}$$

The Modules 12, 41, 42, 44, 46 or 48

By way of example, the functionality of the modules 12, 41, 42, 44, 46 or 48 may be implemented using hardware, software, firmware, or a combination thereof. In a typical software implementation, the modules 12, 41, 42, 44, 46 or 48 would include one or more microprocessor-based architectures having a microprocessor, a random access memory (RAM), a read only memory (ROM), input/output devices and control, data and address buses connecting the same. A person skilled in the art would be able to program such a microcontroller (or microprocessor)-based implementation to perform the functionality described herein without undue experimentation. The scope of the invention is not intended to be limited to any particular implementation using technology either now known or later developed in the future.

Possible Applications

Possible applications for the present invention include an implementation having some combination of the following features:

I. General Overview Description:

By way of example, the specification below is for the design and development of a variable speed drive pump controller (VSD) for a five chamber pump. By way of example, the applications for this specification may range from a water system to general industrial spraying, although the scope of the invention is not intended to be limited to the type of kind of application either now known or later developed in the future.

II. Functional requirements

Figure 7:
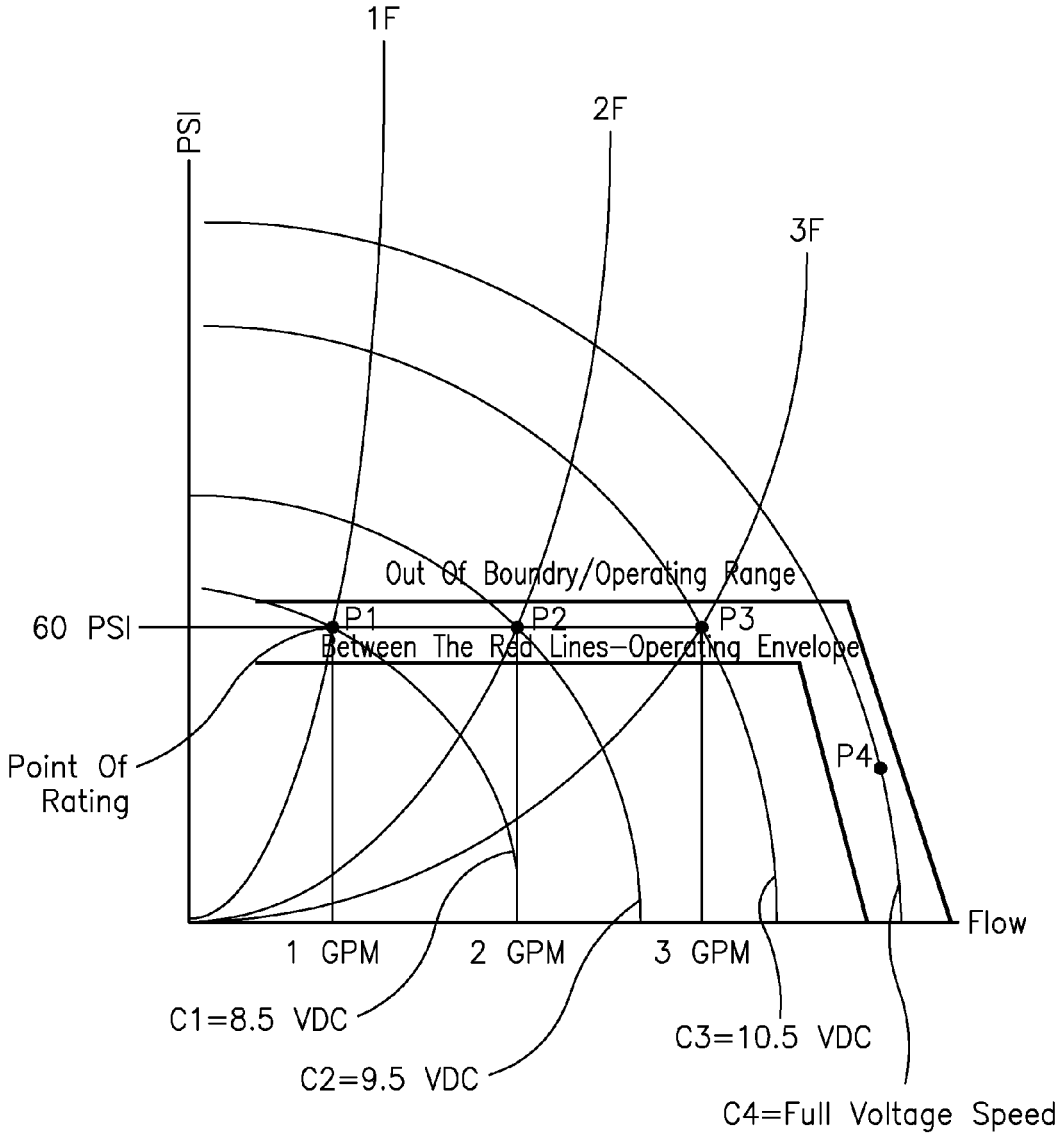
FIG. 7 shows a graph having a flow curve/operating envelope that forms part of PSI in relation to gallon per minute (GPM) according to some embodiments of the present invention.
Figure 8:
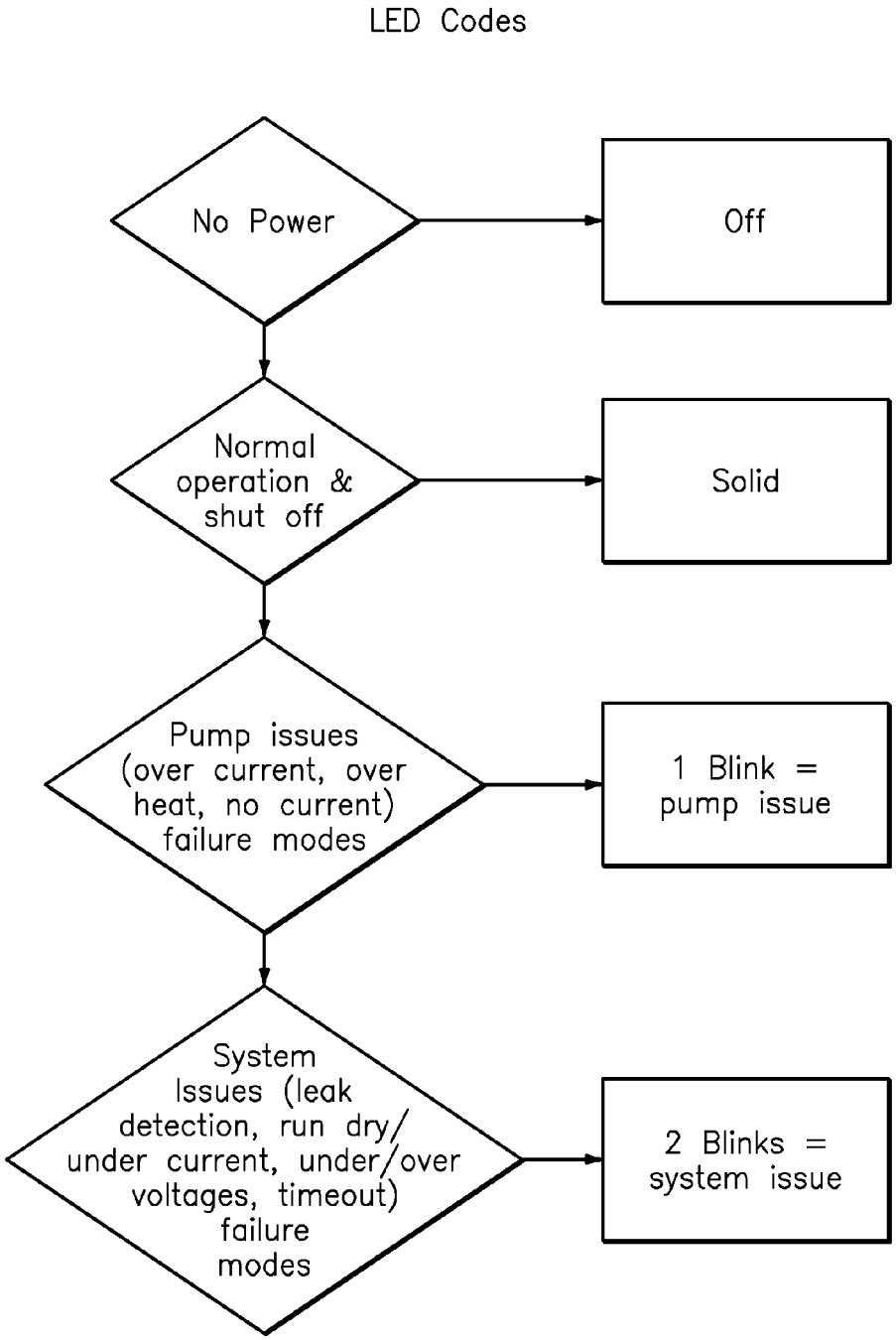
FIG. 8 shows flow chart showing light emitting diode (LED) indicator codes according to some embodiments of the present invention.

1. Application Ratings
   - 1.1. Work in salt and fresh water environments.
   - 1.2. Voltage
     - 1.2.1. Direct Current Unit—9.5 VDC-28.0 VDC
     - 1.2.2. Alternating Current Unit—85 VAC-250 VAC—Phase two of the project to be completed after completion of the DC version.
2. Abbreviations & Definitions
   - 2.1. Abbreviations
     - 2.1.1. #F—Number of outlets/valves/faucets
     - 2.1.2. C#—Flow curve at various voltages
     - 2.1.3. P#—Point of Rating at various pressures and flow
     - 2.1.4. GPM—Gallons Per Minutes
     - 2.1.5. VDC—Voltage Direct Current
     - 2.1.6. VAC—Voltage Alternating Current
     - 2.1.7. MTBF—Mean time between failure
     - 2.1.8. PSI—Pounds per square inch
   - 2.2. Definitions
     - 2.2.1. Outlet—Any flow output of the system
     - 2.2.2. Run Dry—Occurs when the liquid supplied to the pump is either removed or the supply is exhausted.
     - 2.2.3. Prime—The amount of time it takes for the pump to draw water and begin pumping.
3. Performance/Life Expectancy
   - 3.1. Performance
     - 3.1.1 Functional Operations (See FIGS. 6-8)
       - 3.1.1.1 With a VSD pump installed on a vessel/RV and appropriate power source connected, the pump controller, e.g. controller 10 (FIG. 1) or module 40 (FIG. 4), may also run a diagnostic test as set forth and described in FIG. 6 every time the pump experiences an On/Off power cycle. Under a normal operation mode, the water system should be pressurized and maintained at the designed value until a demand is required (outlet opened.)
       - 3.1.1.2 When there is a demand (P1), (P2), or (P3), the pump controller turns the pump on at full speed/voltage, the pump will presumably run outside the operating envelope (high amp/volt), the pump controller may detect this condition and slow down the pump until a preset value of amp/volt is achieved. It may maintain the operation of pump at this value until new condition arises and the pump controller may react to the new condition. All these actions typically happen in a very short time span, e.g., a fraction of a second.
       - 3.1.1.3 As more demand (P2) or (P3) or (P4) arises, the water system drops in pressure and the pump experiences a drop in load/amp draw. The pump controller may detect this new condition and slowly speed up the pump until a preset value (amp/volt) is achieved, and it may maintain the operation of the pump at this value until a new condition arises and the controller shall react to the new condition. This technique may be applied to all the operating points defined as the operating envelope depicted in FIG. 7.

3.1.1.4 If a high demand (P4) is required, the pump controller may maintain full speed/voltage to keep up with the demand until this condition is changed.

3.1.1.5 When a demand is no longer present (outlet closed), the pump experiences a high pressure above the operating pressure, a pressure switch may disconnect the power to the pump.

3.1.1.6 Run-Dry Protection—If there is no fluid in the tank/inlet of pump, the pump controller may detect this condition and shut pump off after some predetermine time, e.g. X minutes. The controller may also turn on pump from time to time to test the empty/leakage condition for some predetermined number of times and send error signal to LED.

3.1.1.7 Learning—During all modes of operation, the pump controller may "Learn" the operating range of voltage/amperage for future reference. The learning may allow the unit to transition in the variation smoothly with less time lost.

3.1.1.8 Over Current/Under Current—Controller may monitor for extremes in amperage outside the learned range, and it shall shut off and blink the LED 1 Blink when this condition happens. See FIGS. 6 and 8.

3.1.1.9 Leak Detection—The unit may monitor for slow leaks over time, when the pump controller detects a slow leak over a period of time with no normal operation, the unit may shut the pump off. A slow leak typically manifests itself as a slow loss of pressure then the pump ramps up to pressure and shuts off. This occurs may occur constantly over time in a leaking situation. This feature can allow for some predetermined period of cycling then shut off and blink the LED 2 blinks. See FIGS. 6 and 8

3.1.1.10 Data Storage

The pump controller may also be configured to store data in on-board's memory, e.g. that may form part of the one or more other modules 14, including the following incidents:

a. Run Dry/Under Current—Record the number of run dry incidents b. Over Current/Motor stalling—Record the number of incidents c. On-Hours for normal operation d. On hours at the time of each incident e. Under voltage/Over voltage—Record the number of incidents f. Leak detection—Record the number of incidents g. Time out—Record the number of incidents 3.2 Life Expectancy—Recommended functional life (MTBF)>500 hours of the box to include operation and water ingress.

4 Physical Features and Dimensions 4.1 VSD housing shall be defined to mount as a base of the motor.

4.2 Power connections may be 12" pigtails of sufficient gauge to handle the 28 amperes and to allow for sufficient wiring from harness to be reliably connected.

4.3 Connections 4.3.1 Pump connections may be based upon the 8 pin Molex MX150 connector or equivalent to be molded into the 4.3.1.2: 2 pins for power in+1 earth pin connection 4.3.1.3: 2 pins for power to motor 4.3.1.4: 2 pins for pressure switch input 4.3.1.5: 2 pins for LED indicator and ON/OFF switch option.

These pins plugged unless needed.

5 Some additional Features 5.1 Thermal overload protection 5.2 Unit shall also, in addition to the software over current protection, utilize hardware redundancy for over current protection.

5.3 Shall have hardware over current protection in the event that the software over current fails.

5.4 Shall conform to PCB outline(s) provided by ITT Flow Control 5.5 SMT/THT construction 5.6 Operating temperature range −10° F. to 150° F.

5.7 Protection from Amperage/Voltage Spikes

The advantages of above implementations are numerous, and by way of example, may include some of that which follows.

Universal equation

Extends and fits any diaphragm pump characteristics and ratings (same software for 30 PSI, 60 PSI, 80 PSI etc pump)

Software tunes to the particular motor characteristics

Functionality primarily depends on the calibration

Easy calibration

Easy portability to AC operations also

Greater number of self diagnostics features can be given (as most of the errors can be a function of current)

Uses ecumenical advance algorithm

The algorithm uses predication logic

Common software may be fit in relation to any diaphragm pump characteristics and ratings (same software for 1 PSI to 250 PSI) once the current handling capabilities are met by the hardware Software could be self-calibrated or externally calibrated Software does not use any pressure "sensors" for its main computational algorithm and does all the calculation based on motor current; so "sensorless."

Software establishes a relationship between motor current and output pressure with its highly advanced algorithm its output pressure control requirements.

Smooth and placid flow at the output.

Discharge pressure remains constant for extended range flow requirements (approximately about 85% of total flow range).

Minimal outlet flow variation with change in input voltages

Rapid and swift response software algorithm with advanced and sophisticated on-board electronics control.

Extended pump life as advanced software assimilate and absorbs all the voltages higher than rated voltages going to the motor.

Subjugated heat generation in motor as a result of no voltages higher than rated one applied to pump.

An array of indicative self diagnostics features provided with the help of superior combination of hardware and software; diagnostics features such as run dry, lock rotor, leak detection, timeout, over voltage, under voltage, over current, etc.

Run-dry of the pump, leak detection in the system, timeout, over voltage, under voltage. These are categorized as system issues.

Over current, no-current (under current), over heating of an enclosure are categorized as pump issues.

These diagnostics are visual indication by blinking the LED at the output.

LED output codes are broadly accumulated as "System" or "Pump" issues/errors

LED output may also be given for each diagnostic feature individually by changing the error code module in the software On-board over temperature cut-off enhances the life of electronics and safe guards the product.

Conserves water by having advanced leak detection feature.

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the present invention is described by way of example in relation to a diaphragm pump, the scope of the invention is intended to include using the same in relation to other types or kinds of pumps either now known or later developed in the future.

Although the invention has been described and illustrated with respect to exemplary embodiments thereof, the foregoing and various other additions and omissions may be made therein and thereto without departing from the spirit and scope of the present invention.

What we claim is:

1. Apparatus comprising:

a pump controller module configured to respond to an input signal containing information about a current being provided from a pump at a motor voltage being provided to the pump; and determine an output voltage signal for providing to the pump containing a correction term to the motor voltage based at least partly on an error correction between the current being provided from the pump at the motor voltage and a set current calibrated from a table at the motor voltage, so as to control the pump to operate at a substantially constant pressure without the direct sensing of pump pressure.

2. Apparatus according to claim 1, wherein the pump controller module comprises a current sensing module configured to:

receive the input signal containing information about the current at the motor voltage, and provide a current sensing signal containing information about the current sensed at the motor voltage; and a current measured module configured to:

receive the current sensing signal containing information about the current sensed at the motor voltage, and provide a measured current signal containing information about the current measured at the motor voltage.

3. Apparatus according to claim 2, wherein the pump controller module comprises a set current module configured to:

receive a motor voltage signal containing information about the motor voltage, and provide a set current signal containing information about the set current calibrated from the table at the motor voltage.

4. Apparatus according to claim 3, wherein the pump controller module comprises a node configured to:

receive the measured current signal containing information about the current measured at the motor voltage, receive the set current signal containing information about the set current calibrated from the table at the motor voltage, and provide an error correction signal containing information about the error correction between the current measured at the motor voltage and the set current calibrated from the table at the motor voltage.

5. Apparatus according to claim 4, wherein the pump controller module comprises a PID controller module configured to:

receive the error correction signal containing information about the error correction between the current measured at the motor voltage and the set current calibrated from the table at the motor voltage, receive the motor voltage signal containing information about the motor voltage, and provide the output voltage signal to control the pump to operate at a substantially constant pressure without the direct sensing of pump pressure.

6. Apparatus according to claim 1, wherein the pump controller module comprises a set current module configured to:

receive a motor voltage signal containing information about the motor voltage, and provide a set current signal containing information about the set current calibrated from the table at the motor voltage.

7. Apparatus according to claim 1, wherein the pump controller module comprises a node configured to:

receive a measured current signal containing information about the current measured at the motor voltage, receive a set current signal containing information about the set current calibrated from the table at the motor voltage, and provide an error correction signal containing information about the error correction between the current measured at the motor voltage and the set current calibrated from the table at the motor voltage.

8. Apparatus according to claim 1, wherein the pump controller module comprises a PID controller module configured to:

receive an error correction signal containing information about the error correction between the current measured at the motor voltage and the set current calibrated from the table at the motor voltage, receive a motor voltage signal containing information about the motor voltage, and provide the output voltage signal to control the pump to operate at the substantially constant pressure without the direct sensing of pump pressure.

9. Apparatus according to claim 8, wherein the table is calibrated for each pump.

10. Apparatus according to claim 9, wherein the determination is based at least partly on characteristics related to voltage and current using the following equation:

$$I=Vm+C,$$

where m=(I1−I2)/(V1−V2),

C=(V1*I2−V2*I1)/(V1−V2), (V1, I1): Low point of curve, and (V2, I2): High point of curve.

11. Apparatus according to claim 1, wherein the table is calibrated for each pump.

12. Apparatus according to claim 1, wherein the determination is based at least partly on characteristics related to voltage and current using the following equation:

$$I=Vm+C,$$

where m=(I1−I2)/(V1−V2),

C=(V1*I2−V2*I1)/(V1−V2), (V1, I1): Low point of curve, and (V2, I2): High point of curve.

13. Apparatus according to claim 1, wherein the apparatus takes the form of a pump system comprising a pump controller module according to claim 1.

14. A method for controlling a pump comprising:

responding to an input signal containing information about a current being provided from the pump at a motor voltage being provided to the pump; and determining an output voltage signal for providing to the pump containing a correction term to the motor voltage based at least partly on an error correction between the current being provided from the pump at the motor voltage and a set current calibrated from a table at the motor voltage, so as to control the pump to operate at a substantially constant pressure without the direct sensing of pump pressure.

15. A method according to claim 14, wherein the method comprises:

receiving a motor voltage signal containing information about the motor voltage, and providing a set current signal containing information about the set current calibrated from the table at the motor voltage.

16. A method according to claim 15, wherein the method further comprises:

receiving the measured current signal containing information about the current measured at the motor voltage, receiving the set current signal containing information about the set current calibrated from the table at the motor voltage, and providing an error correction signal containing information about the error correction between the current measured at the motor voltage and the set current calibrated from the table at the motor voltage.

17. A method according to claim 16, wherein the method further comprises:

receiving the error correction signal containing information about the error correction between the current at the motor voltage and the set current calibrated from the table at the motor voltage, receiving the motor voltage signal containing information about the motor voltage, and providing the output voltage signal to control the pump to operate at the substantially constant pressure without the direct sensing of pump pressure.

18. Apparatus according to claim 14, wherein the table is calibrated for each pump.

19. Apparatus according to claim 14, wherein the determination is based at least partly on characteristics related to voltage and current using the following equation:

$$I=Vm+C,$$

where m=(I1−I2)/(V1−V2),

C=(V1*I2−V2*I1)/(V1−V2), (V1, I1): Low point of curve, and (V2, I2): High point of curve.

20. Apparatus comprising:

means for responding to an input signal containing information about a current being provided from a pump at a motor voltage being provided to the pump; and means for determining an output voltage signal for providing to the pump containing an error correction term to the motor voltage based at least partly on an error correction between the current at the motor voltage and a set current calibrated from a table at the motor voltage, so as to control the pump to operate at a substantially constant pressure without the direct sensing of pump pressure.

21. Apparatus comprising:

a pump controller module configured to respond to an input signal containing information about a current at a motor voltage being provided to a pump; and determine an output signal containing information about the motor voltage based at least partly on an error correction between the current at the motor voltage being provided to the pump and a set current calibrated from a table at the motor voltage being provided to the pump, so as to control the pump to operate at a substantially constant pressure without the direct sensing of pump pressure, wherein the determination is based at least partly on characteristics related to voltage and current using the following equation:

$$I=Vm+C,$$

where m=(I1−I2)/(V1−V2),

C=(V1*I2−V2*I1)/(V1−V2), (V1, I1): Low point of curve, and (V2, I2): High point of curve.

22. A method for controlling a pump comprising:

responding to an input signal containing information about a current at a motor voltage being provided to the pump; and determining an output signal containing information about the motor voltage based at least partly on an error correction between the current at the motor voltage being provided to the pump and a set current calibrated from a table at the motor voltage being provided to the pump, so as to control the pump to operate at a substantially constant pressure without the direct sensing of pump pressure;

wherein the determination is based at least partly on characteristics related to voltage and current using the following equation:

$$I=Vm+C,$$

where m=(I1−I2)/(V1−V2),

C=(V1*I2−V2*I1)/(V1−V2), (V1, I1): Low point of curve, and (V2, I2): High point of curve.

* * * * *